US007343864B2

(12) United States Patent
Canin et al.

(10) Patent No.: US 7,343,864 B2
(45) Date of Patent: Mar. 18, 2008

(54) MODULAR WORKTABLE AND SHELVING UNIT

(76) Inventors: Fabrice Canin, c/o Vic Mobilier de Magasins Inc. 1440 Notre-Dame ouest, Victoriaville, Quebec (CA) G6P 7L7; Eric Belleau, c/o Morelli Design 3964 St. Laurent Blvd., Montreal, Quebec (CA) H2W 1Y3; Michel Morelli, c/o Morelli Design 3964 St. Laurent, Montreal, Quebec (CA) H2W 1Y3

( * ) Notice: Subject to any disclaimer, the term of this patent is extended or adjusted under 35 U.S.C. 154(b) by 444 days.

(21) Appl. No.: 10/965,830

(22) Filed: Oct. 18, 2004

(65) Prior Publication Data

US 2005/0122013 A1 Jun. 9, 2005

(30) Foreign Application Priority Data

Oct. 24, 2003 (CA) ..... 2446451

(51) Int. Cl.
*A47B 37/00* (2006.01)

(52) U.S. Cl. ..... 108/50.02; 108/153.1

(58) Field of Classification Search ..... 106/50.01, 106/50.02, 64, 23, 180, 186, 193, 101, 109, 106/106, 147.11, 147.16, 148; 312/223.6, 312/223.3, 195; 108/96, 153.1, 147.17, 157.13
See application file for complete search history.

(56) References Cited

U.S. PATENT DOCUMENTS 2,005,593 A * 6/1935 Sandberg et al. ..... 108/109
5,121,698 A * 6/1992 Kelley ..... 108/50.02
5,522,324 A * 6/1996 van Gelder et al. ..... 108/50.02
5,622,010 A 4/1997 Weber
5,706,741 A * 1/1998 Thorp et al. ..... 108/193
5,878,673 A * 3/1999 Kramer et al. ..... 108/50.02
6,241,329 B1 * 6/2001 Nielsen ..... 312/223.6
6,283,043 B1 * 9/2001 Stern et al. ..... 108/50.02

(Continued)

FOREIGN PATENT DOCUMENTS

DE 4100675 A1 * 7/1992

*Primary Examiner*—Jose V. Chen
(74) *Attorney, Agent, or Firm*—Guy J. Houle; Ogilvy Renault LLP

(57) ABSTRACT

A modular worktable assembly and a shelving unit are described. The modular worktable assembly has a pair of side panels with a tabletop secured over a top end thereof. A rear, hollow cross-channel is secured between rear vertical end posts of the side panels and has an open top end with a removable cover member for access to an interior thereof. The table platform is held horizontal and elevated above the top edge of the side panels and flush with a top end of the rear hollow cross-channel. The modular shelving unit is characterized in that it has vertical side panels which are formed by a pair of symmetrical side walls immovably secured back-to-back and these side walls each have a pair of outwardly projecting elongated formations formed in a front and rear portion thereof. A plurality of horizontally aligned connecting slots are provided in these formations. The slots in the front portion of the side walls have opposed cavities formed in a top and bottom edge of at least some of the slots for supporting a shelf at an angle between the vertical side panels and permitting one of the side walls of the side panels to be inverted whereby the cavities of interconnected side walls are disposed in aligned relationship.

1 Claim, 12 Drawing Sheets

U.S. PATENT DOCUMENTS 6,427,608 B1 * 8/2002 Crinion ..... 108/50.02
6,588,346 B1 * 7/2003 Bockheim et al. ..... 108/50.02
6,725,784 B2 * 4/2004 Crinion ..... 108/50.01
6,732,662 B2 * 5/2004 Welch et al. ..... 108/109
7,004,081 B2 * 2/2006 Chang ..... 108/50.01

* cited by examiner

MODULAR WORKTABLE AND SHELVING UNIT

TECHNICAL FIELD

The present invention relates to modular structures and more particularly to a modular worktable assembly as well as a modular shelving unit. Both these modular assemblies permit diverse configurations.

BACKGROUND ART

Modular worktable assemblies are well known in the art and, for example, such is described in U.S. Pat. No. 5,622,010, as well as many other patents. Modular shelving assemblies are also numerous in the art. However, there is a need to provide an aesthetically pleasing, versatile modular worktable and shelving unit assemblies which are versatile and comprise a minimum of interconnecting parts for their construction. It also permits easy reconfiguration and with respect to the shelving unit, it permits shelves to be supported at angles. The modular shelving unit and worktable of the present invention are specifically adapted, although not exclusively, for use in pharmacies wherein there is a need to provide ready access to prescription drugs as well as other types of drug products and permitting reconfigurations of these units as it becomes necessary to adapt to modern methods and different drug packaging or working methods.

SUMMARY OF INVENTION

Accordingly, from a broad aspect, the present invention provides a modular worktable assembly comprising a pair of side panels each having front and rear vertical end posts, said end posts having connector attachment means, cross-bars securable between said side panels in a lower portion thereof, a rear hollow cross-channel secured between said rear vertical end posts of said pair of side panels, said rear hollow cross-channels having at least an open top end section with a removable cover member for access to an interior of said hollow cross-channel, aperture means in a lower wall of said rear hollow cross-channel, and a table platform secured to said front vertical end post by an extension bracket and to a support flange formed in a front wall of said rear hollow cross-channel whereby said table platform is held horizontal and elevated above a top edge of said side panels and flush with said top end of said rear hollow cross-channel.

According to a still further broad aspect of the present invention, there is provided a modular shelving unit which comprises a pair of vertical side panels interconnected together by horizontal cross-bars to maintain the side panels in vertical parallel relationship to one another. The side panels have a pair of symmetrical side walls, immovably secured back-to-back in spaced-apart parallel relationship by integrally formed securement flanges. Each side wall having a pair of outwardly projecting elongated formations formed in a front and rear portion of the side wall. The side wall has a recessed intermediate section between the pair of outwardly projecting elongated formations. A plurality of horizontally aligned connecting slots are provided in the pair of projecting elongated formations. The slots in the front and rear portion of the side wall being aligned with one another. At least some slots in the projecting elongated formations of the front portion of the side walls have opposed cavities formed in a top and bottom edge of the at least some of the slots and adjacent an end thereof to form an enlarged slot section for supporting a shelf at an angle between the vertical side panels and permitting one of the side walls of the panel to be inverted whereby the cavities of interconnected side walls are disposed in aligned relationship.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
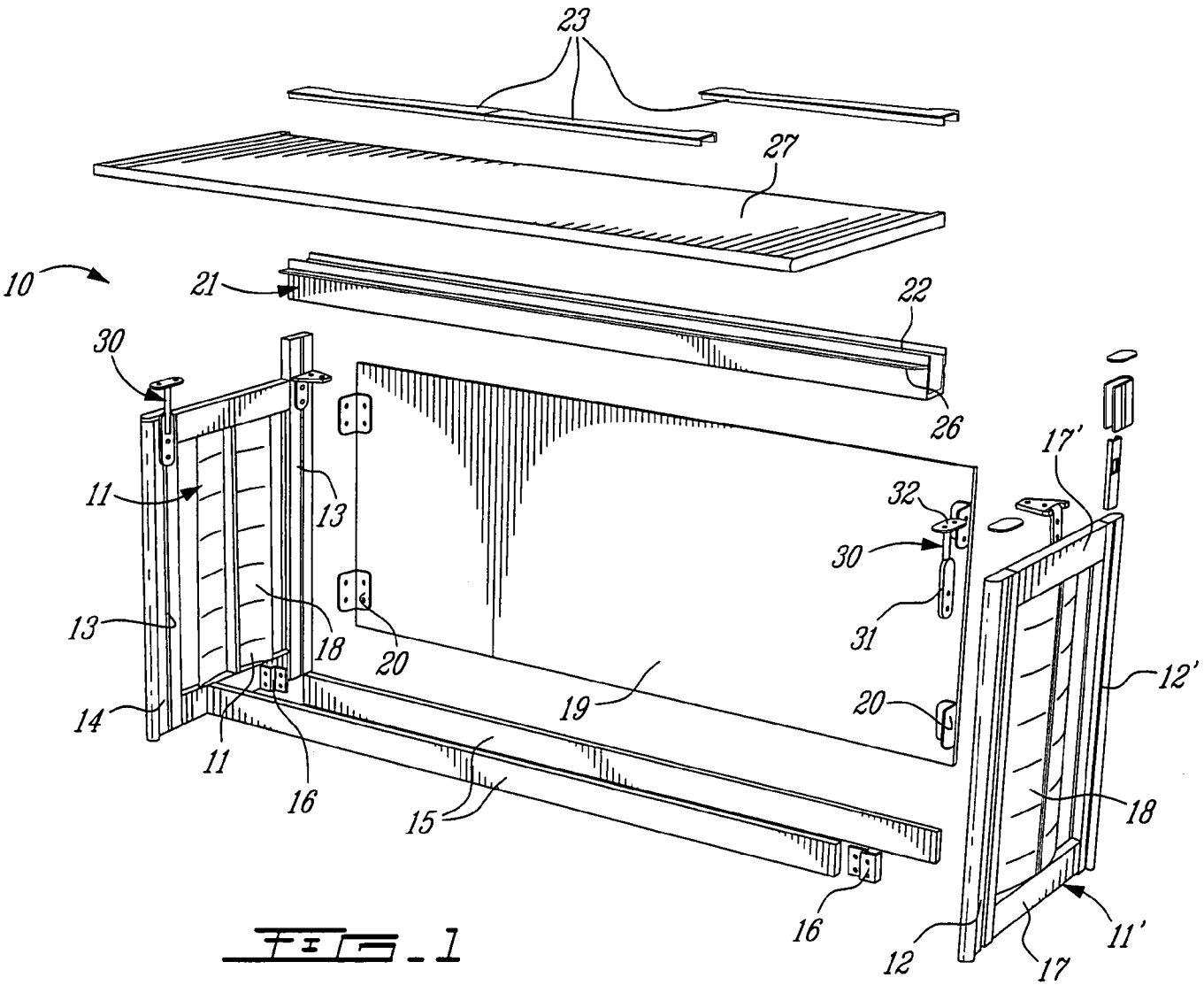
FIG. 1 is an exploded view of the modular worktable assembly of the present invention.
Figure 2:
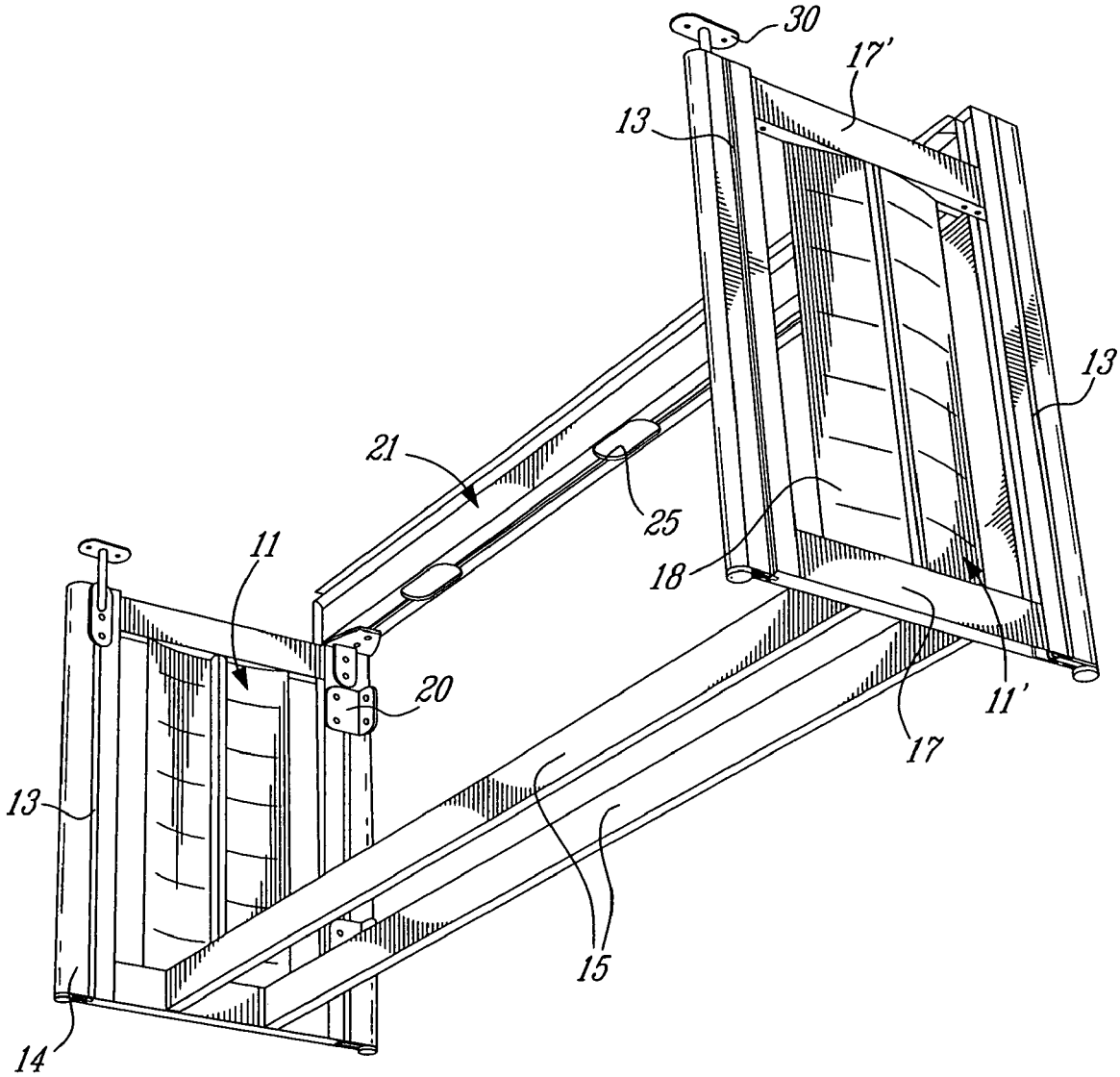
FIG. 2 is a perspective bottom view showing the major structural component parts of the worktable assembly.

Referring now to the drawings, and particularly to FIG. 1, there is shown generally at 10 a modular worktable assembly constructed in accordance with the present invention. The table assembly is comprised of a pair of side panels 11 and 11', each having a front and rear vertical end posts 12 and 12'. The end posts have connector attachment means in the form of slots 13 formed on opposed side walls 14 thereof. Cross-bars 15 are securable between the side panels 11 and 11' and preferably secured by connectors 16 to a lower cross member 17 of the side walls. A pair of aesthetically designed curved side panels 18 are interconnected between a top cross-member 17' and the bottom cross member 17.

As hereinshown, a rear panel 19 may be connected to the rear end posts 12' of opposed side panels 11 and 11' by connecting brackets 20 which are secured in the connecting slots 13 by fastening bolts, well known in the art. A rear hollow cross-channel 21 has an open top end 22 in at least a section thereof and the open top end is concealed by one or more removable cover members 23 whereby to provide access to the interior of the hollow cross-channel whereby wiring for the worktable can be concealed.

Figure 7:
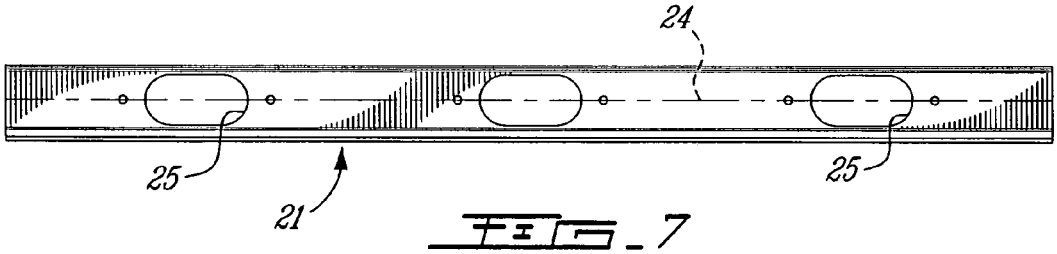
FIG. 7 is a bottom view of the rear hollow cross-channel.
Figure 8:
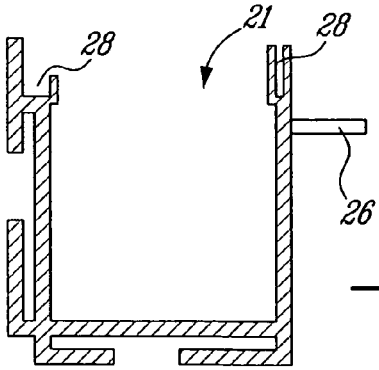
FIG. 8 is a cross-section view of FIG. 7.
Figure 9:
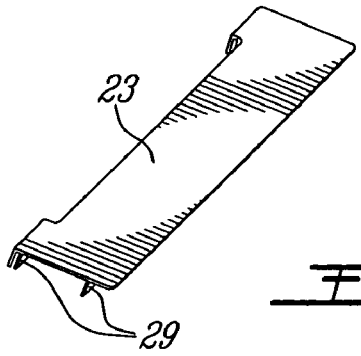
FIG. 9 is a perspective view of the removable cover member.

As shown in FIG. 7, the bottom wall 24 of the hollow cross-channel is provided with apertures 25 through which the cable would exit. With reference to FIG. 8, it can also be seen that the hollow cross-channel 21 is an extrusion member and is provided with a support flange 26 whereby to secure it along a rear edge of a table platform 27, as shown in FIG. 1. The extrusion is also provided with slots 28 to snappingly receive therein the connecting flanges 29 of the removable cover members 23, as more clearly illustrated in FIG. 9.

The table platform 29 is a rectangular platform although it is conceivable that that platform could have a recess section therein or a shape in its front edge for working purposes. This table platform 27 is secured to the front vertical end posts 12 by extension brackets 30 which also have a lower connector portion 31 to receive fasteners for securement in the fastening slot 13. A top connector flange 32 would secure to the underside of the table. The rear edge of the table 27 would also be secured to the flange 26 by fasteners disposed underneath the flange.

Figure 10:
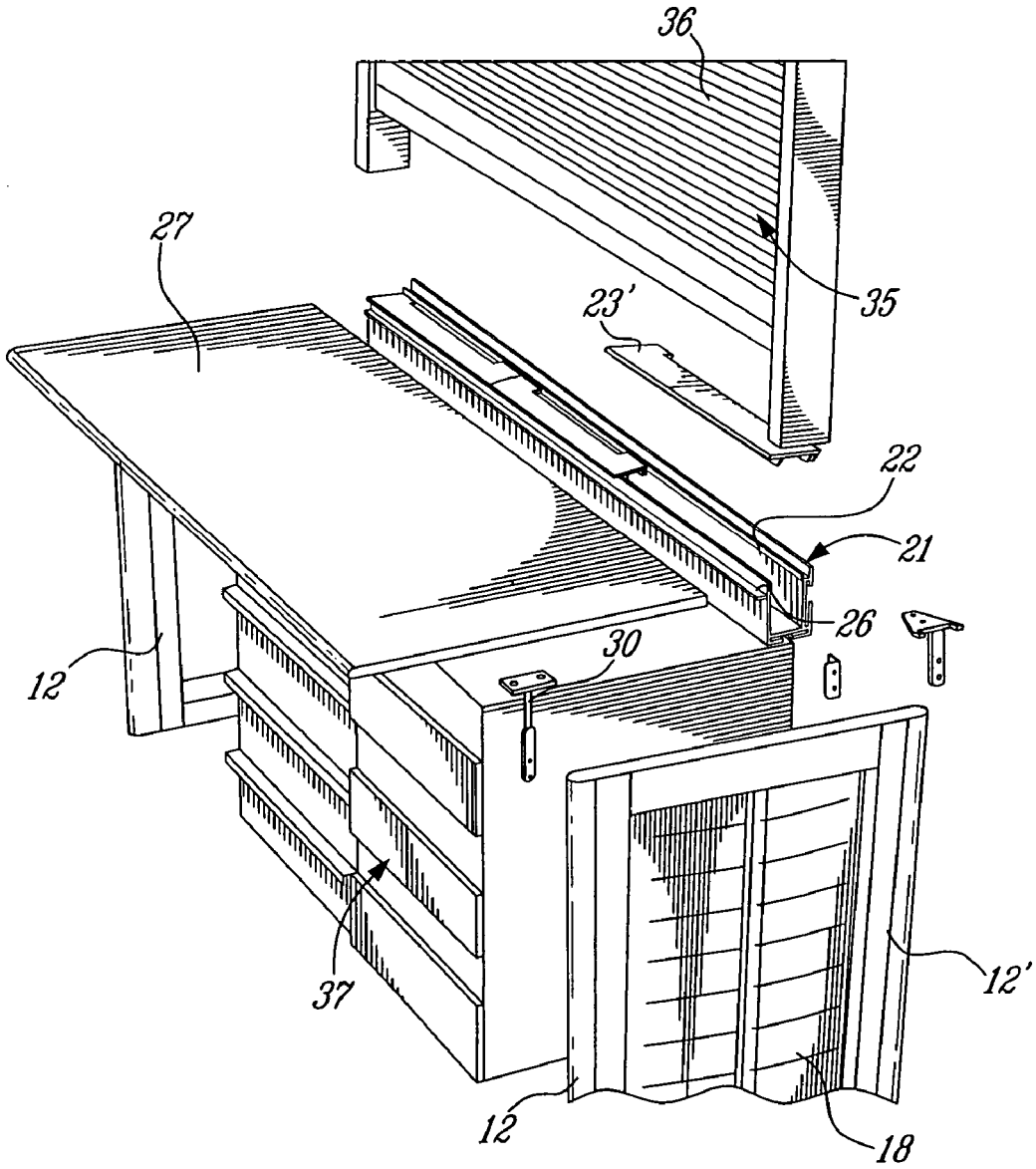
FIG. 10 is an exploded perspective view of the modular worktable showing a rear panel adapted to be connected to the hollow cross-channel member.

As shown in FIG. 10, the modular design of the worktable also permits for rear panels 35 to be secured by connector means integrated with the removable cover members 23'. The rear panels are provided with a privacy screen 36 or may have a screen with attachment means to receive all sorts of attachments thereon such as instruction tabs, etc. for a specific work function to be performed on a work schedule. Cupboards 37 are secured under the table and attached to the side panels and cross members.

Figure 3:
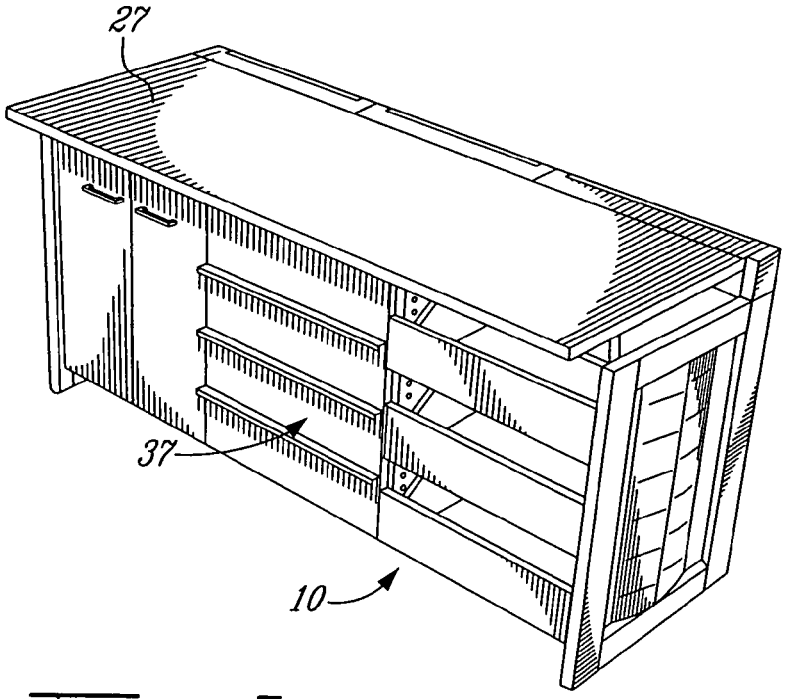
FIGS. 3 and 4 are perspective views showing a version of the modular worktable as well as an extension part thereof.
Figure 4:
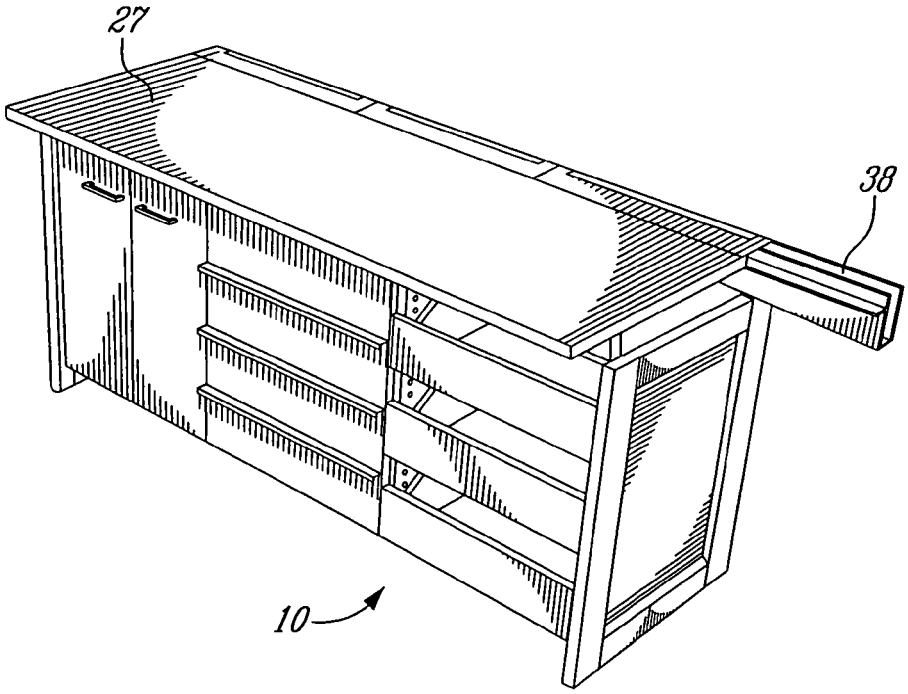
Figure 5:
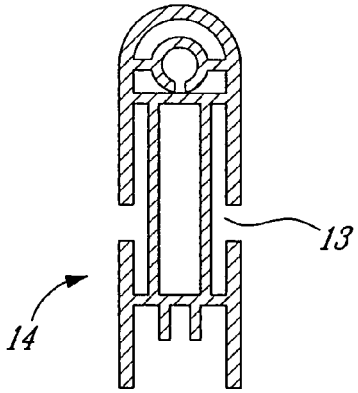
FIG. 5 is a plan view of the vertical end posts of the side panels.
Figure 6:
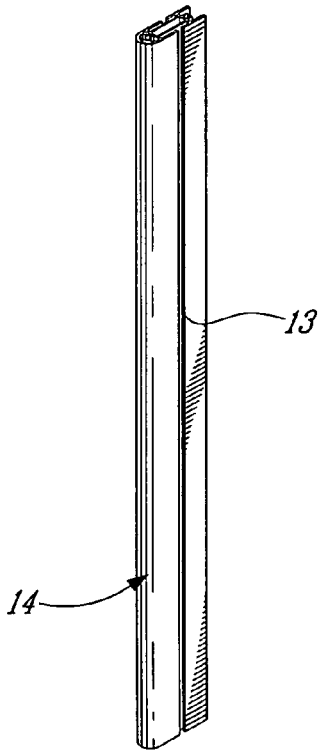
FIG. 6 is a perspective view thereof.

FIGS. 3 and 4 illustrate specific designs of a modular shelving unit constructed in accordance with the present invention and this modular table can be extended by securing further side panels to an extension section 38 of the hollow cross-channel. Accordingly, it is within the ambit of the present invention to cover various configurations of the modular worktable provided such configurations fall within the scope of the appended claims.

Figure 11:
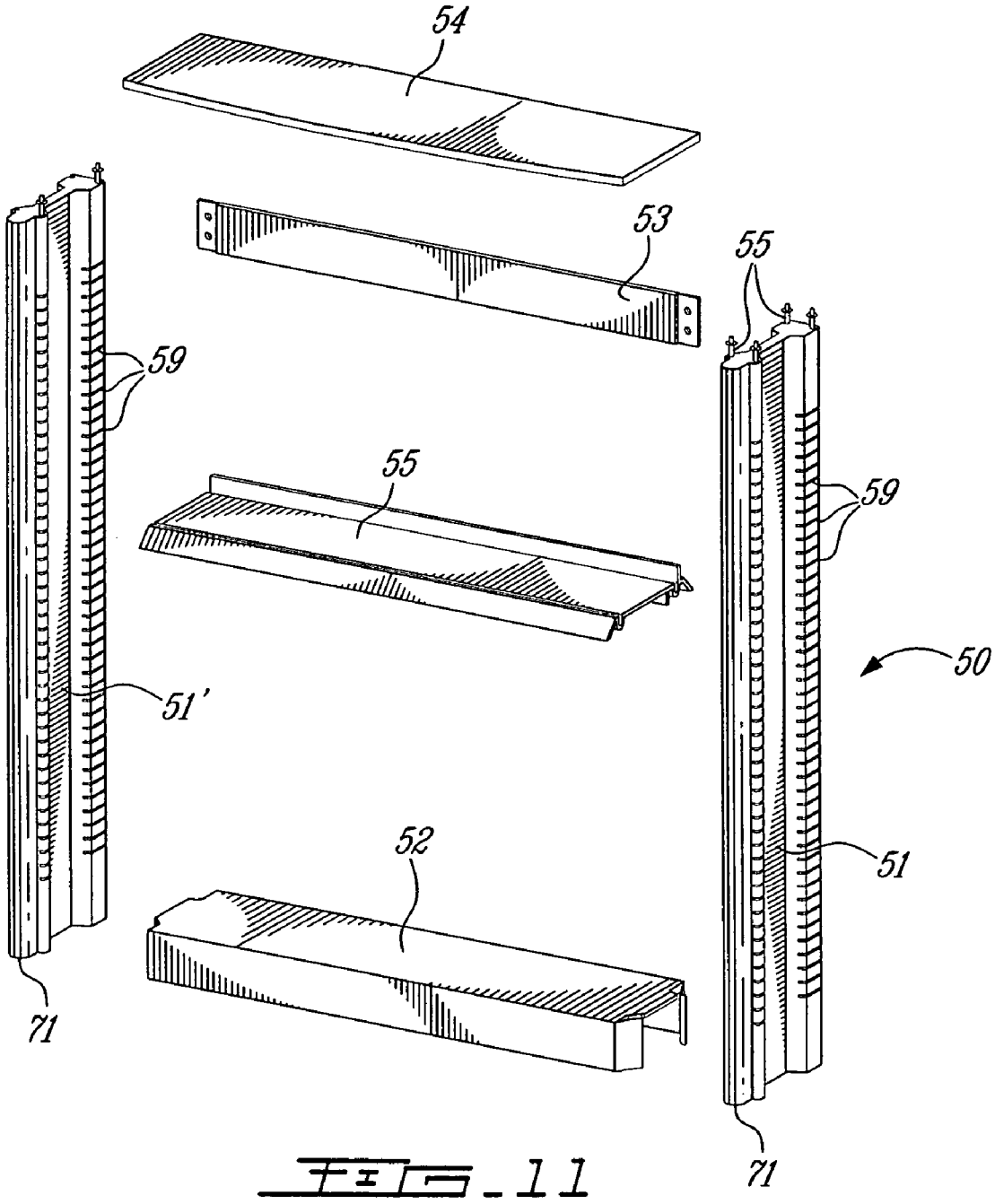
FIG. 11 is an exploded view of the modular shelving unit of the present invention.
Figure 12:
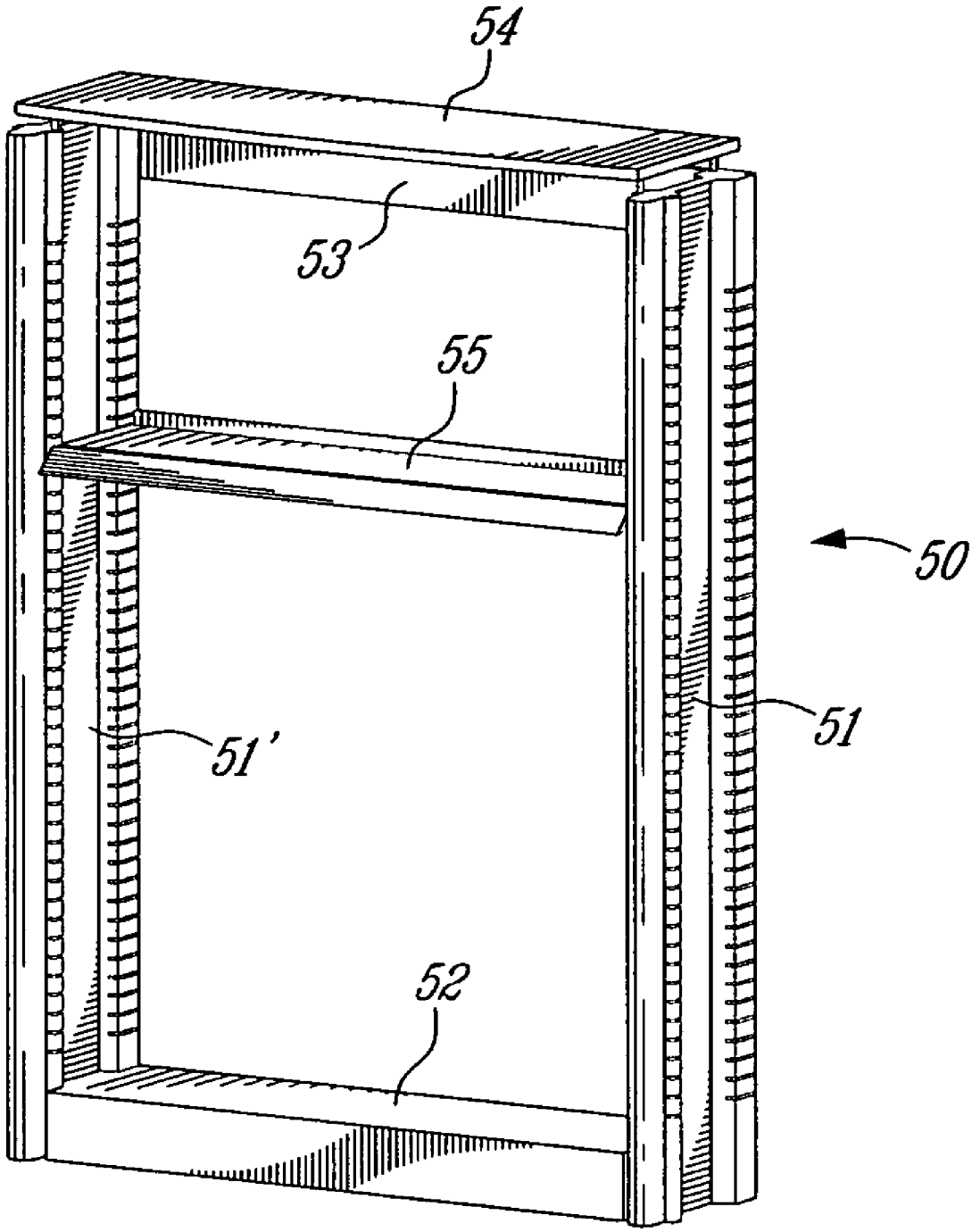
FIG. 12 is an assembled view of the modular shelving unit.

With reference now to FIGS. 12 to 19, there will be described the construction of the modular shelving unit. With reference to FIGS. 11 and 12, which are exploded view and assembled view of the modular shelving unit, it can be seen that this shelving unit 50 is comprised of a pair of vertical side walls 51 and 51', interconnected together by horizontal cross-bars or cross-members 52 at the bottom of the side panels and 53 extending at the top of the side panels. A top shelf 54 also interconnects the panels together. This top shelf is secured to pin connectors 55, as better illustrated in FIG. 16 and secured in a top end of the side panels as will be described later. One or a plurality of shelves 55 are removably secured between the side walls 51 and 51', although only one is hereinshown for simplicity of illustration. With reference now to FIGS. 14, 15 and 17 and 18, it can be seen that the side panels are each constituted by a pair of symmetrical side walls 56 and 56' which are immovably secured back-to-back in spaced-apart parallel relationship by integrally formed securement flanges 57 and 57' which are welded together whereby to form a hollow structural vertical side panel. Each of the side walls 56 and 56' have a pair of outwardly projecting elongated formations 58 and 58' which are formed in a front and rear portion of the side walls. A plurality of horizontally aligned connecting slots 59 are cut out in the pair of projecting elongated formations. At least some of the slots in the projecting elongated formations of the front portion 58 of the side walls have opposed cavities 60 and 60' formed in a top and bottom edge 61 and 62 of the slots adjacent an end 63 thereof for supporting the shelf 55 at an angle between the vertical side panels. As can be seen, the shelves are provided adjacent their opposed end edges 65 with extension pins 66 which enter into these slots for interconnection therewith.

Figure 15:
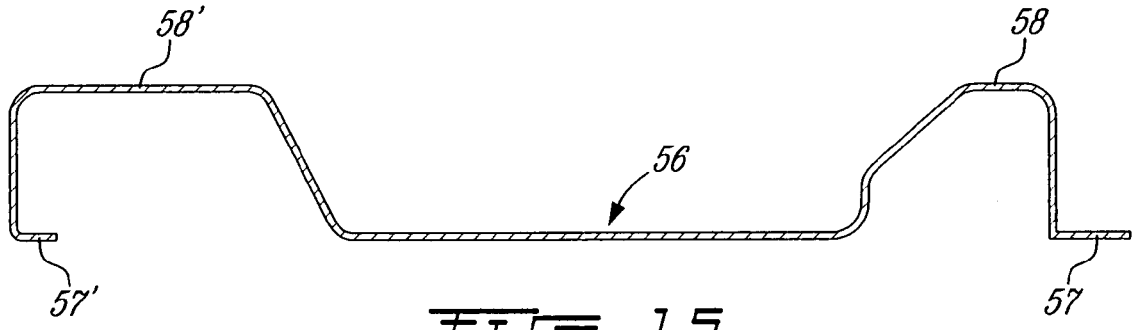
FIG. 15 is a cross-section view of a symmetrical side wall.
Figure 16:
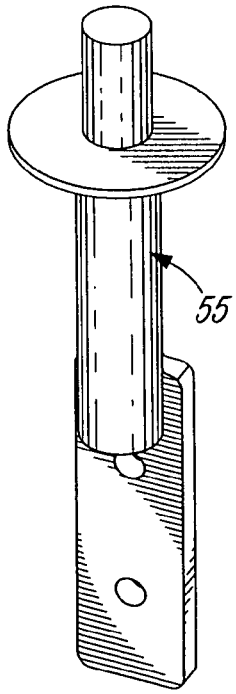
FIG. 16 is a perspective view of a pin connector.

As previously described, the side panels have a pair of symmetrical side walls 56 and 56' and the shape thereof is better illustrated in FIG. 15. The reason for the cavities 60 and 60' to be disposed on opposed sides of the slot is that it permits the side walls to be inverted one with respect to the other in back-to-back relationship while permitting the shelves on opposed shelving units to be hinged in the same direction, i.e., the slots with the cavities being in the front formations 58.

Figure 17:
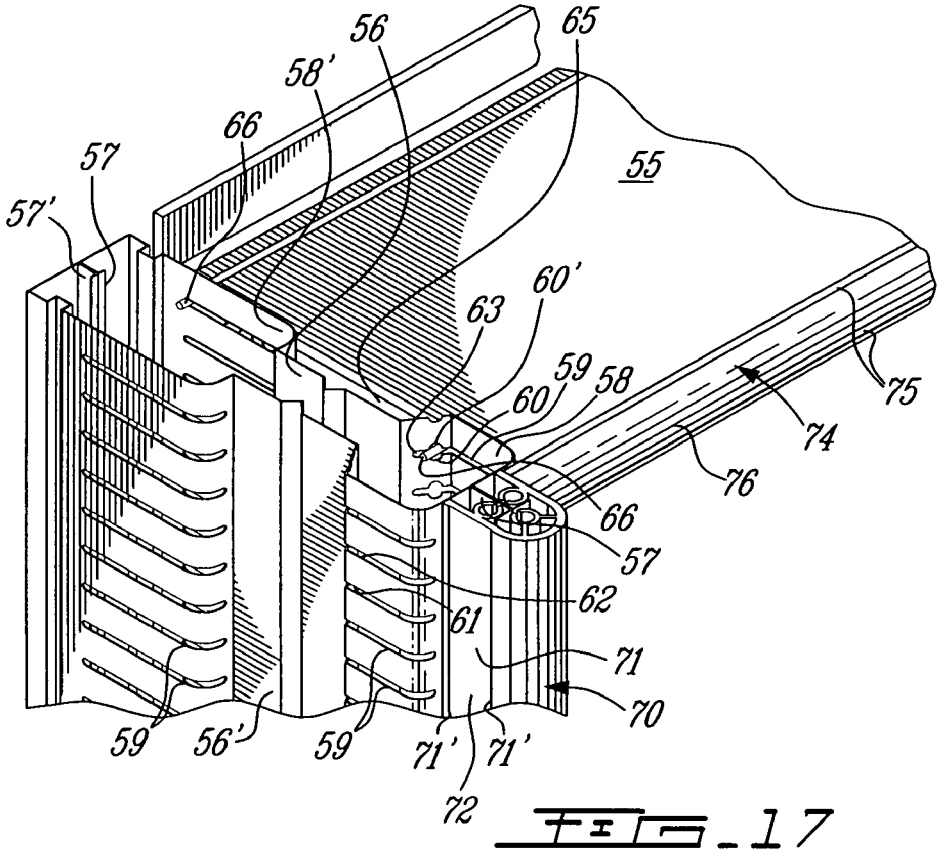
FIG. 17 is a top, partly fragmented, perspective view showing a side panel and its interconnection to a shelf.
Figure 18:
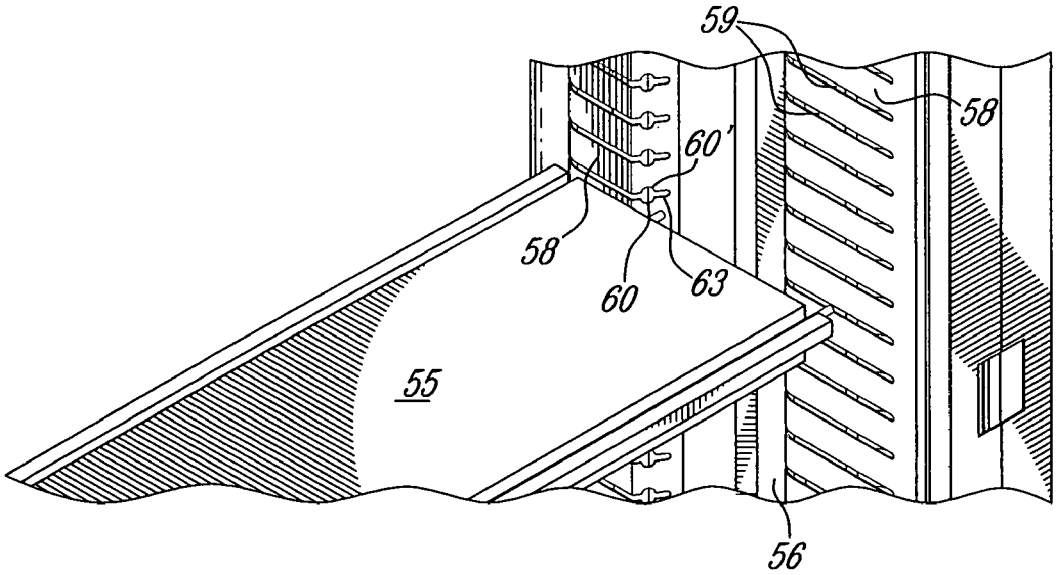
FIG. 18 is an exploded perspective view, partly fragmented, showing the configuration of the slot having the opposed cavities formed therein for supporting shelves at angles.
Figure 19:
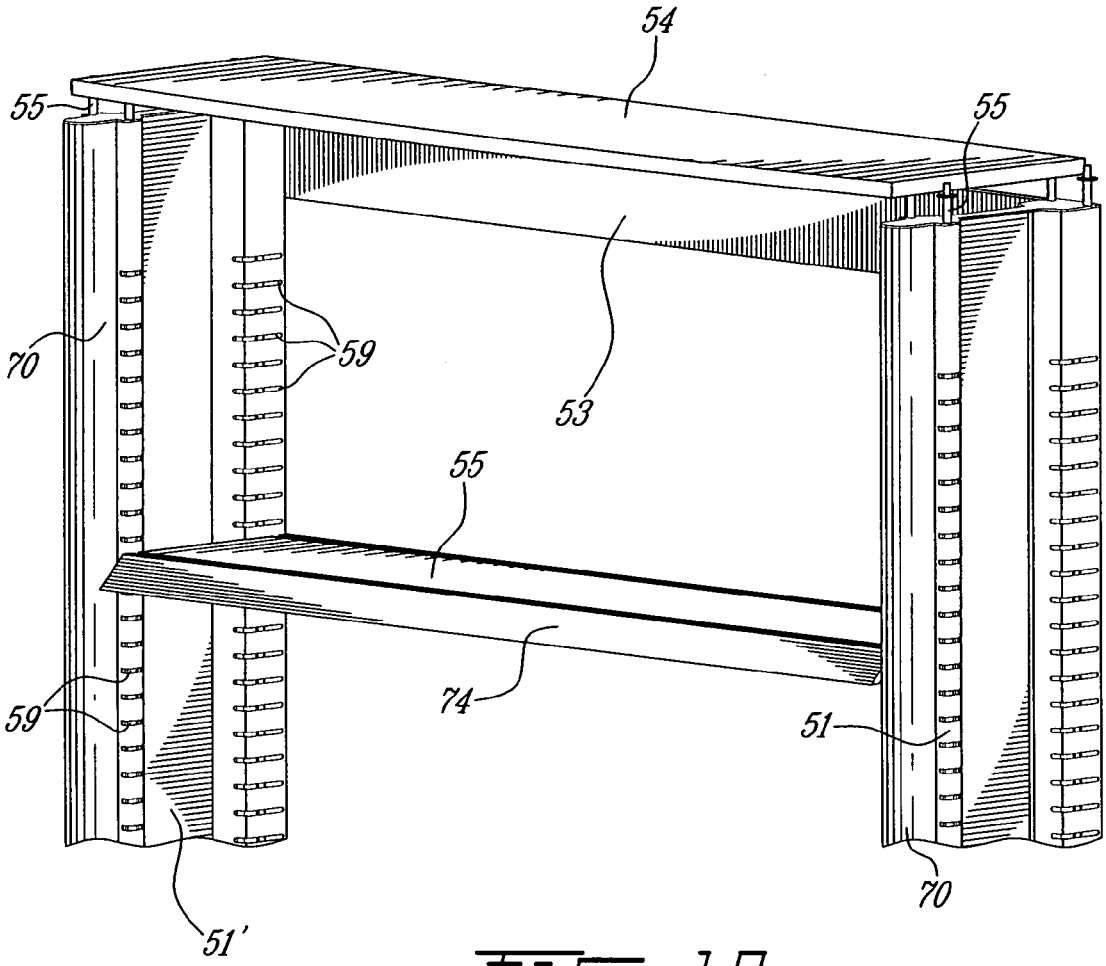
FIG. 19 is a perspective view of a top portion of a shelving unit.

As shown in FIG. 17, an extrusion member 70 is secured to the flanges 57 of the side panel and is provided with elongated throughbores to receive adjustable support legs 71 at the bottom thereof, as is well known in the art. These are usually threaded bolts having a flat bottom disc. These extrusions 70 also have support slots 71' formed in a side wall 72 thereof whereby to receive labels 73 to identify products disposed on a particular shelf or for other purposes. The front edge of the shelf 55 is also provided with an extrusion 74 having retaining flanges 75 to receive therebetween further labels 76 to further identify products. Accordingly, this shelving unit is quite practical to pharmacists. Also the fact that some of the shelves can be angulated permits it to support products that need visual access throughout the depth of the shelf.

Figure 13:
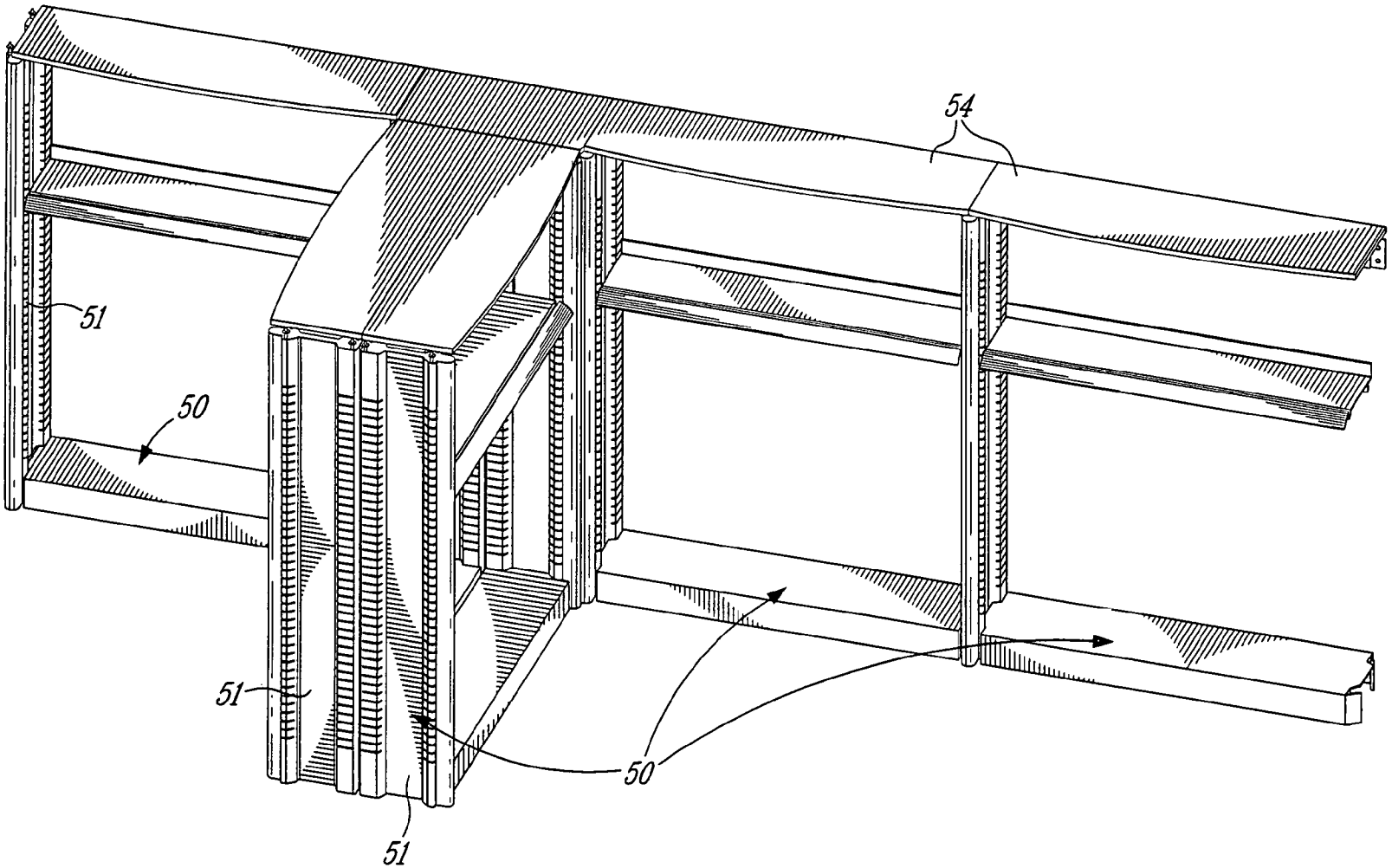
FIG. 13 is a perspective view showing the modular shelving unit in a shelving system comprising a plurality of shelving units.

As shown in FIG. 13, this modular shelving unit can be used in conjunction with many other shelving units and are interconnected together in aligned or transverse relationship to suit the need of the user person.

Figure 14:
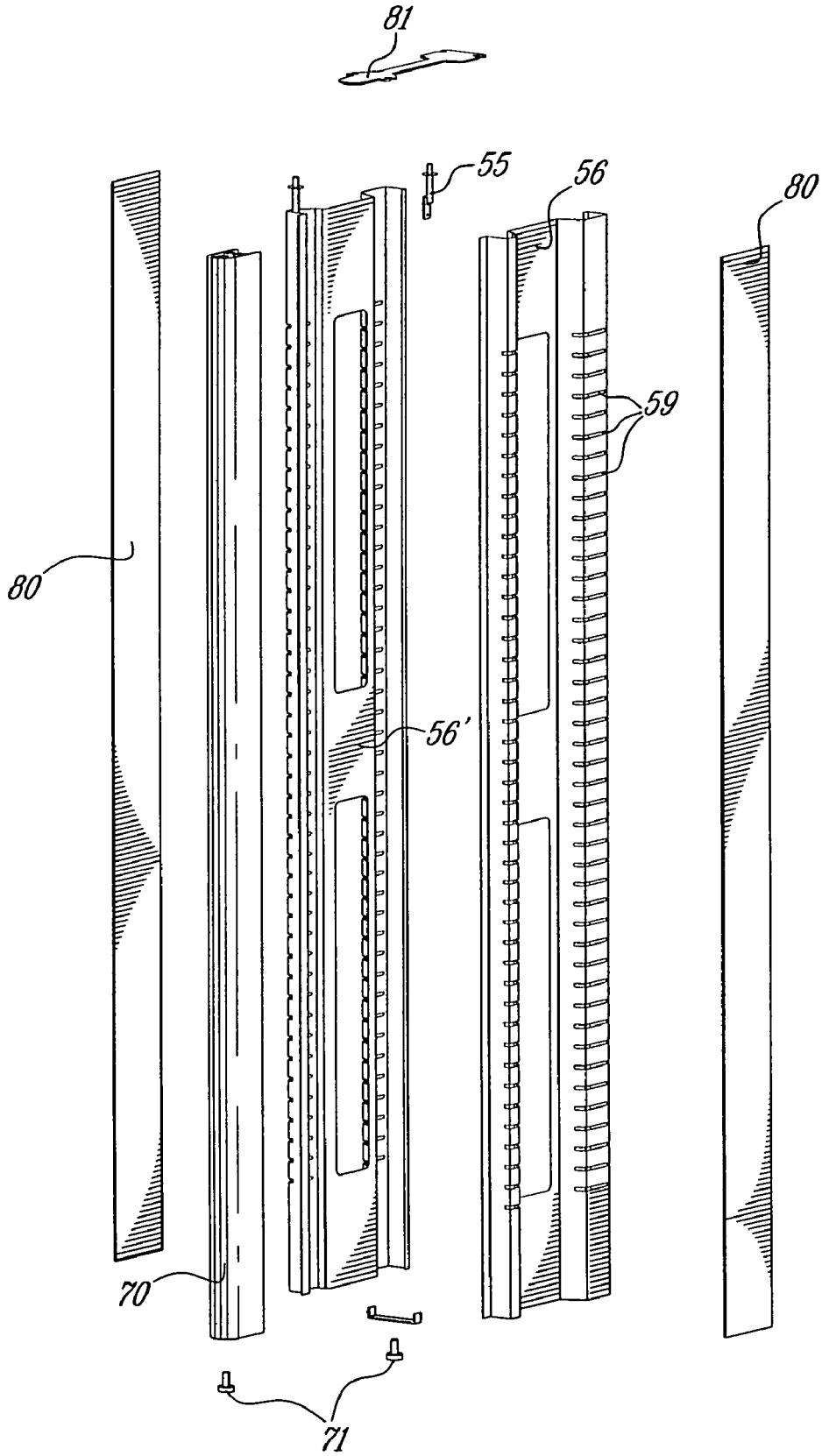
FIG. 14 is an exploded view of a vertical side panel showing component parts thereof.

The side panels can also be aesthetically pleasing by securing thereto cosmetic panels, as shown in FIG. 14, identified by reference numeral 80. The pin connectors 55 also permit for the top wall 54 or top shelf to be supported elevated and this is purely for cosmetic purpose. Covers 81 are also securable by the pins 55 to the open end of the vertical side panels.

An important feature of the side walls 56 and 56' is that the slots 59 in the projecting formations extend into the curved, front facing, side walls 58" (See FIG. 17) of each formation 58 and 58' thereby permitting the shelves 55 with their projecting pins 66 to be inserted and slide out from the front of the shelving unit. These shelves 55 can therefore be moved without removing the products thereon and this is an important feature particularly to pharmacies.

It is within the ambit of the present invention to cover any obvious modifications of the preferred embodiment described herein, provided such examples fall within the scope of the appended claims. For example, the shelving unit can be integrated inside cupboards to provide adjustability for shelving and need not be an open shelving system as herein illustrated. The side panels may be constructed of plastic extrusion members or a combination of aluminum and plastic parts.

The invention claimed is:

1. A modular shelving unit comprising a pair of vertical side panels interconnected together by horizontal cross-bars to maintain said side panels in vertical parallel relationship to one another, said side panels having a pair of symmetrical side walls, immovably secured back-to-back in spaced-apart parallel relationship by integrally formed securement flanges projecting from opposed side edges of said side-walls; said securement flanges of each said panels when placed back-to-back, being welded together to immovably secure said side panels; each side wall having a pair of outwardly projecting elongated formations formed in a front and rear portion of said side wall, said side wall having a recessed intermediate section between said pair of outwardly projecting elongated formations and a plurality of horizontally aligned connecting slots in said pair of projecting elongated formations, said slots in said front and rear portion of said side wall being aligned with one another, at least some slots in said projecting elongated formations of said front portion of said side walls having opposed cavities formed in a top and bottom edge of said at least some of said slots adjacent an end thereof to form an enlarged slot section for receiving an extension pin projecting from an end edge of a shelf in a forward portion thereof with said extension pin supported below said bottom edge of said slot having said enlarged slot section thereby supporting said shelf at an angle between said vertical side panels, said cavities formed in said top and bottom edge of said at least some of said slots permitting one of said side walls of said side panel to be inverted whereby said cavities or interconnected side walls are disposed in aligned relationship while permitting said extension pin to lie below said bottom edge of said slot.

* * * * *